US006074245A

United States Patent [19]

Soes

[11] Patent Number: 6,074,245

[45] Date of Patent: Jun. 13, 2000

[54] METHOD FOR PRODUCING A CONNECTION OF DATA TRANSMISSION LINES, AND PLUG CONNECTOR

[75] Inventor: Lucas Soes, Rosmalen, Netherlands

[73] Assignee: The Whitaker Corporation, Wilmington, Del.

[21] Appl. No.: 09/125,917

[22] PCT Filed: Feb. 26, 1997

[86] PCT No.: PCT/IB97/00168

§ 371 Date: Aug. 25, 1998

§ 102(e) Date: Aug. 25, 1998

[87] PCT Pub. No.: WO97/32367

PCT Pub. Date: Sep. 4, 1997

[51] Int. Cl.[7] ..... H01R 27/00

[52] U.S. Cl. ..... 439/516

[58] Field of Search ..... 439/516, 493, 439/941, 579

[56] References Cited

U.S. PATENT DOCUMENTS 4,773,879 9/1988 Pauza ..... 439/579
5,467,062 11/1995 Bouroughs ..... 439/34

*Primary Examiner*—Khiem Nguyen
*Assistant Examiner*—J. F. Duverne

[57] ABSTRACT

The method and the plug connector are employed in the transmission of data at high frequencies to reduce propagation delay differences in data transmission lines, where a data transmission line is connected to a plug connector having a conductive structure located between a conductor connection contact and an associated plug transfer contact, where during production, the propagation delay difference between the signals on the two conductors is measured and compensated for by removing conductor sections from the conductive structure for which the shorter propagation delay is measured in order to extend the length of the signal path.

8 Claims, 1 Drawing Sheet

METHOD FOR PRODUCING A CONNECTION OF DATA TRANSMISSION LINES, AND PLUG CONNECTOR

BACKGROUND OF THE INVENTION

1. Field of the Invention

The invention relates to a method for producing a connection of data transmission lines and to a plug connector, in particular for use in such a method.

2. Summary of the Prior Art

Fluctuations in the production methods mean that two conductors in a line are never completely identical. When such lines are used for data transmission in the microwave range, these fluctuations lead to so-called propagation delays between the signals on individual conductors of a line. The higher the frequency and the higher the data rate, the greater is the risk of interference due to erroneous data transmission.

U.S. Pat. No. 5,470,244 specifies an arrangement and a method for preventing interference due to crosstalk. For this purpose, individual conductor tracks are interrupted within a multi-pole electrical plug connector and the interrupted connections are rearranged in a second position, which is arranged above the first conductor tracks. Capacitive and inductive coupling are achieved by superposition and by parallel routing of specific conductor pairs.

Taking this prior art as a departure point, the object of the invention is to specify a connection method for data transmission lines and a plug connector, in particular for carrying out this method, with which propagation delay differences can be reduced.

SUMMARY OF THE INVENTION

As regards the method, this object is achieved by means of a method having the features of Patent claim 1. Preferred developments emerge from subclaims 2 and 3.

It is advantageous that the propagation delay difference between two conductors can be reduced in small steps. This is achieved by virtue of the fact that during the method of producing a connection of plug connector and data transmission line, the propagation delay difference between the conductors is measured and it is possible to remove or sever individual conductor sections from the conductive structure in the plug connector, which leads to an altered propagation delay in the plug connector.

As regards the arrangement, the object is achieved by means of an arrangement having the features of Patent claim 4. Preferred developments emerge from Subclaims 5 to 10.

It is advantageous that the plug connector can be used together with different data transmission lines having various propagation delay errors. This is achieved by virtue of the fact that each conductor in the plug connector is connected to a plug transfer contact, by means of an essentially identical conductive structure, comprising identical conductor sections. This conductive structure can then be processed in such a way that it is possible to compensate for various propagation delay differences.

It is furthermore advantageous that the plug connector is simple to produce. This is achieved by virtue of the fact that both the conductor connection contacts and the plug transfer contacts as well as the conductive structure can be produced from a single stamping. This is also achieved by virtue of the fact that the conductive structure is arranged on a printed circuit board or is produced from a metallized plastic substrate.

BRIEF DESCRIPTION OF THE DRAWINGS

FIG. 1 shows a perspective illustration of a plug connector which is cut open in the longitudinal axis parallel to the plane of the conductive structures, before the data transmission line has been connected to the plug connector and before the propagation delay difference between conductors has been compensated for; and FIG. 2 shows a perspective illustration of the same plug connector after the data transmission line has been connected to the plug connector and after the propagation delay difference between the conductors has been compensated for.

DETAILED DESCRIPTION OF THE PREFERRED EMBODIMENT

Figure 1:
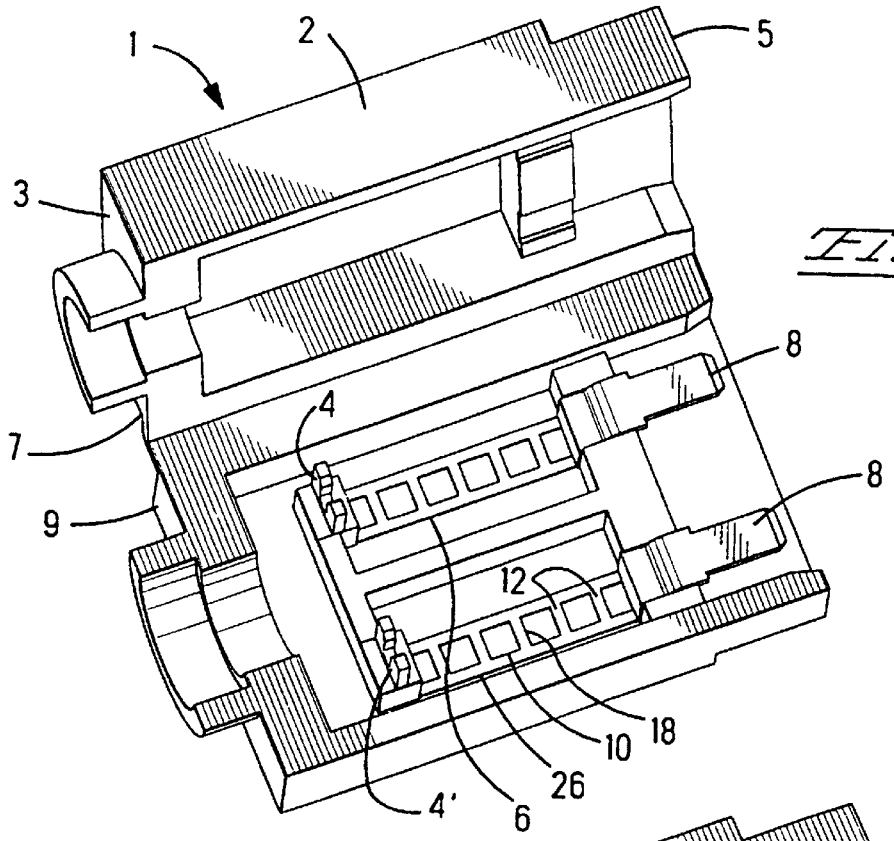

The plug connector 1 comprises a housing 2 with a conductor connection side 3 and a plug transfer side 5. The housing 2 comprises a cover part 7 and a base part 9 matching the latter. On the conductor connection side 3, the housing 2 has two conductor connection contacts 4, 4', which are designed as an insulation piercing terminal connection. On the plug transfer side 5, the housing 2 has two plug transfer contacts 8, 8', which are designed as blade pins. The blade pins are angled at one end in such a way that the plug transfer contacts 8, 8' can be introduced in a clamping manner into metallized holes in a printed circuit board. The conductor connection contacts 4, 4' are respectively connected by means of a conductive structure 6, 26 to the plug transfer contacts 8, 8'. The conductive structure 6, 26 comprises a plurality of individual conductor sections 10, which are multiply connected to one another at crossover points 12. The conductive structure 6, 26 may also have an essentially three-dimensional structure.

In FIG. 1, the conductive structures 6, 26 are designed identically for both conductors 22, 24. Each conductive structure 6, 26 comprises two longitudinal conductor sections 16 which have the same length and represent an electrical current path of identical length for the connection of the conductor connection contact 4, 4' to the plug transfer contact 8, 8'. The longitudinal conductor sections 16 are connected at a plurality of crossover points 12 by means of a plurality of transverse conductor sections 18. The length of the path covered by the electrical current is identical for both conductive structures 6, 26 within the plug connector 2. FIG. 1 illustrates the state of the plug connector 1 before a data transmission line 20 has been connected.

Figure 2:
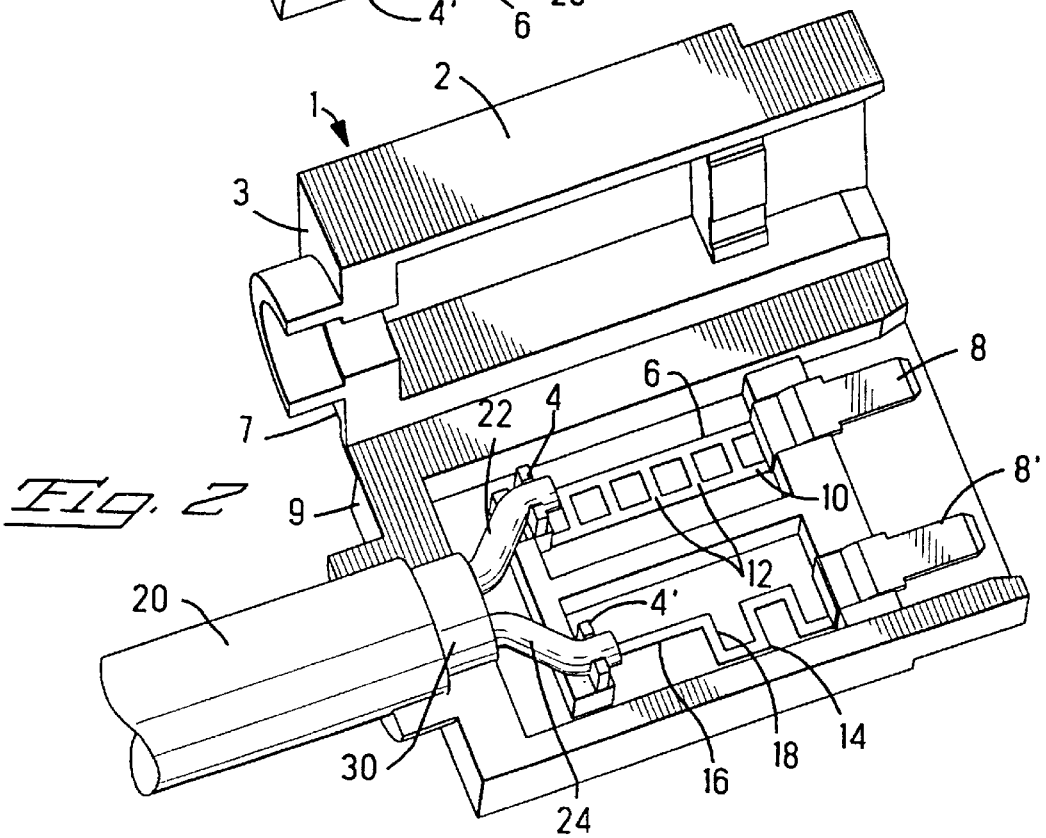

FIG. 2 illustrates the state after the data transmission line 20 has been connected and after the propagation delay difference between the two conductors 22, 24 has been measured and, as far as possible, compensated for. The data transmission line 20 comprises two conductors 22, 24. At least one end 30 of the data transmission line 20 is connected to a plug connector 1. The data transmission line 20 and the housing 2 are electromagnetically screened. At the end 30, the electromagnetic screens of the data transmission line 20 and the housing 2 are connected to one another.

In FIG. 2, various conductor sections have been removed from one of the conductive structures 6, 26. Whereas the first conductive structure 6 for the first conductor 22 is still identical to the conductive structures of FIG. 1, the second conductive structure 26 for the second conductor 24 has an altered conductor track 14.

Since individual conductor sections 10 have been removed from the longitudinal conductor section 16 in the case of the conductive structure 26 on the side of the second conductor 24, the second conductive structure 26 on the side of the conductor 24 represents a longer path for the electrical current than the first conductive structure 6 on the side of the first conductor 22.

The method for producing a connection of data transmission lines comprises the following method steps:

In a preparation step, a data transmission line 20 is connected to the plug connector 1. For this purpose, the conductors 22, 24 are fixed to the conductor connection contacts 4, 4' by means of insulation piercing terminal technology.

In the next step, the propagation delay difference between signals on the first conductor 22 and on the second conductor 24 is measured. Since, prior to the measurement, the plug connector 1 has the same conductive structure 6, 26, the same conductor connection contacts 4, 4' and the same plug transfer contacts 8, 8' for both conductors 22, 24, it is possible to measure the propagation delay difference of the data transmission line by way of the combination of the line 20 and the plug connector 1. In this way, any further propagation delay differences which may arise within the plug connector 1 are also taken into account in the propagation delay measurement.

In the next step, an individual conductor section 10 is removed from a longitudinal conductor section 16 in the case of the conductor 24, for which a shorter propagation delay has been measured than for the other conductor 22. As a result, the path on this conductor and hence the propagation delay are lengthened.

The propagation delay difference between the first conductor 22 and the second conductor 24 is then measured once again.

In the next step, firstly an individual conductor section 10 is once again removed from a longitudinal conductor section 16 between two crossover points 12, to be precise also on the side of the conductor 24 for which the shorter propagation delay was measured in the preceding step.

The propagation delay difference between the first conductor 22 and the second conductor 24 is then once again measured, as described above. The result of this second propagation delay measurement will be smaller than the result of the first propagation delay measurement.

The difference between the first and the second measurement is to be attributed to the conductor section 10 just removed. On that side of the conductor 22, 24 where the current path is lengthened by the removal of conductor sections 10, the propagation delay becomes longer and the difference between the propagation delay of the first conductor 22 and the propagation delay of the second conductor 24 becomes smaller. The method steps of measurement and removal can be repeated several times in succession. After each removal of a further conductor section 10, a smaller propagation delay difference is measured. When the propagation delay difference measured in this way is smaller than half of the decrease between two successive measurements, further removal of a conductor section 10 will no longer result in an improvement in the propagation delay difference.

The combination of data transmission line 20 and plug connector 1 is now optimally matched with regard to the propagation delay difference between the individual conductors 22, 24.

The conductor sections 10 are removed by being broken out, by milling, by etching or by means of laser beam processing.

Should the optimum be missed, because one conductor section 10 too many has been removed on one side, then it is likewise possible to remove an individual conductor section 10 from the still intact conductive structure 6 on the opposite side.

The measurement necessitates a very accurate apparatus which simulates data transmission at a very high data rate.

The cover part 7 and the base part 9, which matches the latter, of the housing 2 are connected to one another in a clamping manner by means of a push-button mechanism (not shown here).

When the two housing parts are joined together, the electromagnetic screening of the housing 2 is also achieved.

We claim:

1. A connector, for data transmission lines having at least two conductors; comprising: a housing having at least two conductor connection contacts connected to corresponding plug transfer contacts by corresponding conductive structures, characterized in that at least one conductive structure has individual conductor sections connected to one another at crossover points, and that it is possible to produce different conductor tracks having different lengths by severing or removing various conductor sections of the conductive structure.

2. The connector according to claim 1, characterized in that the conductive structure comprises at least two longitudinal conductor sections which are arranged parallel and are connected to the conductor connection contacts and plug transfer contacts, have the same length and are connected to each other by means of further transverse conductor sections.

3. The connector according to claim 2, characterized in that the conductor connection contacts are designed as an insulation piercing terminal connection.

4. The connector according to claim 2, characterized in that the plug transfer contacts are designed as blade pins.

5. The connector according to claim 2, characterized in that the transfer contacts are of angled design to be introduced in a clamping manner into metallized holes in a printed circuit board.

6. The connector according to claim 2, characterized in that the conductive structure is designed as a stamping.

7. The connector according to claim 2, characterized in that the conductive structure is built up on a printed circuit board.

8. The connector according to claim 2, characterized in that the conductive structure is contructed as a plastic structure coated with metal.

* * * * *